US009761162B2

(12) United States Patent
Murakami

(10) Patent No.: US 9,761,162 B2
(45) Date of Patent: Sep. 12, 2017

(54) ARRAY SUBSTRATE FOR DISPLAY PANEL AND METHOD FOR INSPECTING ARRAY SUBSTRATE FOR DISPLAY PANEL

(71) Applicant: Mitsubishi Electric Corporation, Tokyo (JP)

(72) Inventor: Katsuaki Murakami, Kumamoto (JP)

(73) Assignee: Mitsubishi Electric Corporation, Tokyo (JP)

( * ) Notice: Subject to any disclaimer, the term of this patent is extended or adjusted under 35 U.S.C. 154(b) by 116 days.

(21) Appl. No.: 14/617,261

(22) Filed: Feb. 9, 2015

(65) Prior Publication Data

US 2015/0235582 A1 Aug. 20, 2015

(30) Foreign Application Priority Data

Feb. 20, 2014 (JP) ..... 2014-030873

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01)

(58) Field of Classification Search
CPC ..... G09G 3/006; G09G 3/3648
USPC ..... 324/760.01
See application file for complete search history.

(56) References Cited

U.S. PATENT DOCUMENTS 6,677,171 B1 * 1/2004 Nagata ..... G02F 1/1309 257/E27.111
6,940,300 B1 * 9/2005 Jenkins ..... G09G 3/006 324/754.03
2009/0179875 A1 * 7/2009 Li ..... G09G 3/3648 345/204
2015/0015820 A1 1/2015 Masutani et al.

FOREIGN PATENT DOCUMENTS

JP H11-316389 A 11/1999
JP 2015-018144 A 1/2015

* cited by examiner

*Primary Examiner* — Billy Lactaoen
(74) *Attorney, Agent, or Firm* — Studebaker & Brackett PC

(57) ABSTRACT

A plurality of source signal lines extend parallel to each other. A plurality of gate signal lines extend parallel to each other and intersect the plurality of source signal lines. At least any one of array inspecting terminals is provided. The one array inspecting terminal is connected to two or more signal lines of the plurality of gate signal lines. The other array inspecting terminal is connected to two or more signal lines of the plurality of source signal lines. To perform an inspection for a unit of the two or more signal lines by detecting a value of a voltage or a current generated in the signal lines, the array inspecting terminals are configured to receive an inspection signal for generating the voltage or the current.

10 Claims, 5 Drawing Sheets

ARRAY SUBSTRATE FOR DISPLAY PANEL AND METHOD FOR INSPECTING ARRAY SUBSTRATE FOR DISPLAY PANEL

BACKGROUND OF THE INVENTION

Field of the Invention

The present invention relates to an array substrate, a method for inspecting an array substrate, and a method for inspecting a display panel.

Description of the Background Art

A display panel is provided with an array substrate. The array substrate has a glass substrate on which a display circuit is located to form display portions. An array inspection includes a technique, which has been known, of writing electrical charge on each of pixels forming the display portion and reading the electrical charge maintained in the pixels to inspect gate signal lines and source signal lines of semiconductor switching elements for breaks and short circuits, the pixels for defects, and the semiconductor switching elements for failures. The array inspection typically causes each of inspection needles (probes) to collectively come into contact with an inspection terminal located at each of the gate signal lines and each of the source signal lines and then inputs an inspection signal to each of the gate signal lines to successively operate the semiconductor switching elements formed at each intersection while inputting an inspection signal to each of the source signal lines to write the electrical charge on the pixels.

In general, terminals (mounting terminals) for mounting semiconductor chips and flexible print cables (FPCs) in the following steps may be used as the inspection terminals, or the inspection terminals may be provided separately near the terminals. The inspection terminals are provided in this manner, allowing for the inspection of the display circuit in a range of the terminals to the display portion.

In the technique of inspecting the array substrate as described above, the inspection terminals connected to the plurality of gate signal lines and the plurality of source signal lines are probed individually, so that a probe unit (unit including a plurality of probes mounted thereon) serving as an inspection jig needs to be manufactured for each of types in which the inspection terminals are disposed differently.

Meanwhile, a panel lighting inspection is performed in a panel state. The panel state is a state in which the display panel including the array substrate and a display element is formed. For example, liquid crystals are sealed between the array substrate and a counter substrate to form a liquid crystal display panel. The panel lighting inspection displays an image on the display panel and determines whether the image is properly displayed. For example, the panel lighting inspection similar to the technique of inspecting the array substrate probes all of the inspection terminals of the source signal lines and the gate signal lines, inputs the inspection signals to the source signal lines and the gate signal lines, and then checks the image to determine whether each of the pixels performs a correct display.

In recent times, a circuit capable of collectively controlling the plurality of gate signal lines and the plurality of source signal lines is provided beforehand on the array substrate, and a collective lighting inspection that enables a specific display with the extremely small number of probes is also applied.

Unlike the inspection technique of individually probing the inspection terminals each located at the plurality of gate signal lines and the plurality of source signal lines, the technique of the collective lighting inspection eliminates influences of a resolution of a display panel and a design (such as the number of bumps) of a semiconductor chip on an inspection device, achieving general-purpose inspections at low cost.

In the above-mentioned inspection technique, a lighting inspecting circuit including a plurality of inspection semiconductor switching elements or the like has been located in a semiconductor chip mounting region including the semiconductor chip mounted therein. However, the semiconductor chip mounting region needs to be reduced in size with miniaturization of the semiconductor chip and a narrow frame of the display panel, so that the lighting inspecting circuit has conceivably been divided into a plurality thereof located in a region except for the semiconductor chip mounting region (see Japanese Patent Application Laid-Open No. 11-316389 (1999), for example).

In recent times, while a high resolution of the display panel and a high density of the semiconductor chips result in miniaturization of the mounting terminals of the semiconductor chips and the inspection terminals disposed around the mounting terminals, the intervals between the mounting terminals and the inspection terminals have had a tendency to become narrow. This makes stable probing difficult. At the same time, manufacturing the probes is also difficult.

Moreover, using the collective lighting inspecting circuit of the conventional technology enables to inspect wiring of the display portion, the semiconductor elements, and wiring from the mounting terminals of the semiconductor chips to the display portion regardless of the high resolution of the display panel and the high density of the semiconductor chips, but the lighting state actually needs to be checked. Thus, the inspections need to be performed after steps are advanced to a level that enables display. For example, in a case of a liquid crystal display apparatus, the array substrate and the counter substrate overlap each other, and the liquid crystals need to be sealed therebetween. Therefore, when a defect is found in the array substrate in the collective lighting inspection, the counter substrate, the liquid crystals, and the cost that has been spent in manufacturing are wasted. In this respect, the array inspection for a single array substrate is desired.

SUMMARY OF THE INVENTION

It is an object of the present invention to provide an array substrate capable of performing stable probing upon an array inspection.

An array substrate according to the present invention includes a plurality of first signal lines, a plurality of second signal lines, a pixel switch element, and a first array inspecting terminal. The plurality of first signal lines extend parallel to each other. The plurality of second signal lines extend parallel to each other and intersect the plurality of first signal lines. The pixel switch element is located at an intersection of each of the plurality of first signal lines and each of the plurality of second signal lines. The first array inspecting terminal is connected to two or more third signal lines of the plurality of first signal lines. To perform an inspection for a unit of the two or more third signal lines by detecting a value of a voltage or a current generated in the two or more third signal lines, the first array inspecting terminal is configured to receive an inspection signal for generating the voltage or the current.

A method for inspecting an array substrate according to the present invention is a method for inspecting an array substrate described below. The array substrate includes a plurality of first signal lines, a plurality of second signal lines, a pixel switch element, and a first array inspecting terminal. The plurality of first signal lines extend parallel to each other. The plurality of second signal lines extend parallel to each other and intersect the plurality of first signal lines. The pixel switch element is located at an intersection of each of the plurality of first signal lines and each of the plurality of second signal lines. The first array inspecting terminal is connected to two or more third signal lines of the plurality of first signal lines. In the method for inspecting an array substrate according to the present invention, an inspection signal for generating a voltage or a current in the two or more third signal lines is input to the first array inspecting terminal, and an inspection for a unit of the two or more third signal lines is performed by detecting the voltage or the current.

In the array substrate and the method for inspecting an array substrate according to the present invention, the first array inspecting terminal is connected to the two or more third signal lines. Thus, the first array inspecting terminal can be provided in a relatively great size, and thus the stable probing can be performed upon the array inspection.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

<Array Substrate Before Array Inspection>

Figure 1:
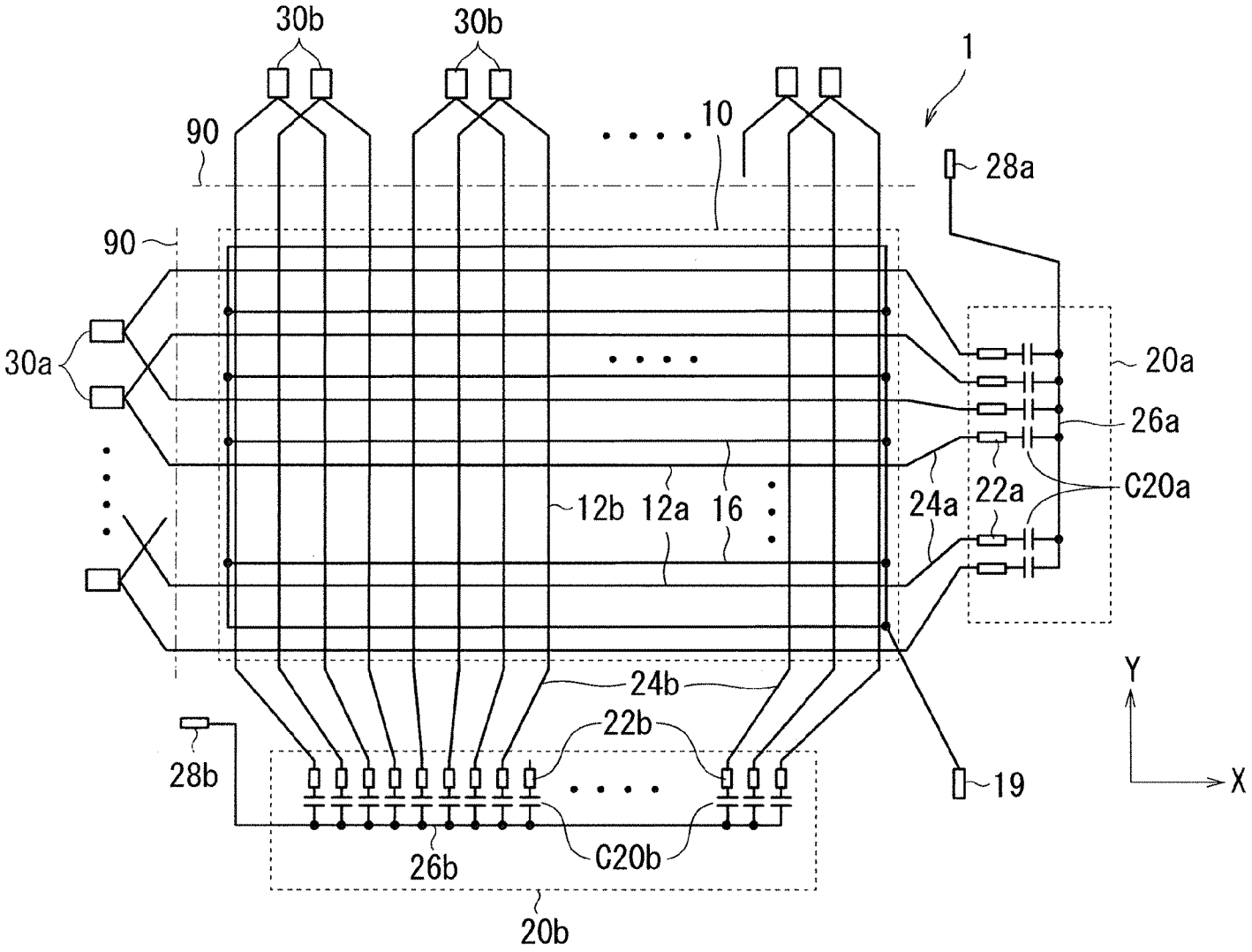
FIG. 1 is a diagram schematically showing an example of a configuration of a circuit of an array substrate according to a first preferred embodiment.

FIG. 1 is a configuration diagram schematically showing an example of a circuit formed on an array substrate 1 according to a first preferred embodiment according to the present invention. The array substrate 1 is used in a display apparatus (such as a liquid crystal display apparatus).

The array substrate 1 includes a substrate (such as a transparent substrate and a glass substrate as the more detailed example), which is not shown, and various structural components described below are located on this substrate. As shown in FIG. 1, a display region 10 and semiconductor chip mounting regions 20*a*, 20*b* are formed in the array substrate 1 according to the first preferred embodiment.

A plurality of gate signal lines 12*a* and a plurality of source signal lines 12*b* are located in the display region 10. The plurality of gate signal lines 12*a* extend parallel to each other. Hereinafter, the extending direction of the gate signal lines 12*a* is referred to as an X direction. The plurality of source signal lines 12*b* extend parallel to each other and intersect the plurality of gate signal lines 12*a*. For example, the plurality of source signal lines 12*b* extend in a Y direction substantially orthogonal to the X direction.

Also in the illustration of FIG. 1, a plurality of common wires 16 are located on the array substrate 1. The plurality of common wires 16 extend in the X direction, and each of them is adjacent to each of the gate signal lines 12*a* with an interval therebetween. The plurality of common wires 16 has one ends connected to each other and the other ends connected to each other in the X direction. In the illustration of FIG. 1, a common wire terminal 19 is also located on the array substrate 1. The common wire terminal 19 is connected to the common wires 16, and a common potential is applied to the common wires 16 through the common wire terminal 19.

Figure 2:
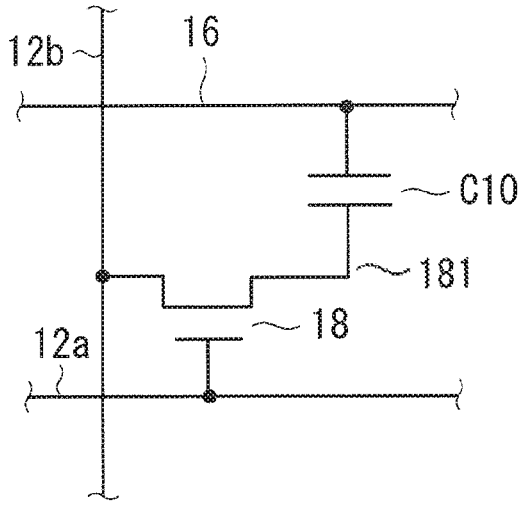
FIG. 2 is a diagram schematically showing an example of a configuration of a circuit of a pixel.

Each region surrounded by the gate signal lines 12*a* and the source signal lines 12*b* corresponds to a pixel region. Pixels as a whole are formed in a matrix, for example. FIG. 2 shows the more detailed example of a configuration of a circuit included in one pixel. As shown in FIG. 2, a pixel switch element (here, a display thin film transistor (TFT)) 18 is located at an intersection of the gate signal line 12*a* and the source signal line 12*b*. A control electrode (gate electrode) of the pixel switch element 18 is connected to the gate signal line 12*a*, and a source electrode of the pixel switch element 18 is connected to the source signal line 12*b*. A drain electrode of the pixel switch element 18 is connected to a pixel electrode 181, which is not shown, and the pixel electrode 181 is connected to the common wire 16 through a storage capacitor C10. The pixel electrode 181 is an electrode for applying voltage to a display element (such as a liquid crystal). The pixel switch element 18 selects conduction or non-conduction between the source signal line 12*b* and the pixel electrode 181.

A signal is input to the gate signal line 12*a* to turn the pixel switch element 18 on. A signal is input to the source signal line 12*b* in this state, and a voltage is then charged in the storage capacitor C10. The voltage charged in the storage capacitor C10 corresponds to a voltage applied to the pixel (more specifically, a display element, such as a liquid crystal, corresponding to the pixel). The display element changes display in response to the voltage.

In the illustration of FIG. 1, the pixel switch 18 and the storage capacitor C10 are omitted to make the configuration easy to see. The circuit in FIG. 2 is formed at all the intersections of the plurality of gate signal lines 12*a* and the plurality of source signal lines 12*b*, for example, and the circuits as a whole are disposed in a matrix, for example.

The semiconductor chip mounting regions 20*a*, 20*b* are regions in which semiconductor chips (gate driving circuit (gate driver IC) or source driving circuit (source driver IC)) are mounted. For example, the gate driving circuit (not shown) that outputs the signal to the gate signal line 12*a* is mounted in the semiconductor chip mounting region 20*a*, and the source driving circuit (not shown) that outputs the signal to the source signal line 12*b* is mounted in the semiconductor chip mounting region 20*b*.

In the illustration of FIG. 1, a plurality of output terminals 22*a*, a plurality of capacitor elements C20*a*, and a break inspecting wire 26*a* are located in the semiconductor chip mounting region 20*a*. The output terminals 22*a* are provided side by side in the Y direction, for example, and are each connected to the gate signal line 12*a* through a lead 24*a*. The output terminals 22*a* are also connected to output bumps of the semiconductor chip (gate driving circuit). Thus, the semiconductor chip is electrically connected to the gate signal lines 12*a* through the output terminals 22*a* and the leads 24*a*.

The output terminals 22*a* are also each connected to the common break inspecting wire 26*a* through the capacitor element C20*a*. The break inspecting wire 26*a* is connected to a break inspecting terminal 28*a* located on the array substrate 1. The capacitor elements C20*a*, the break inspecting wire 26*a*, and the break inspecting terminal 28*a* are used for inspecting a break in the gate signal lines 12*a* and the leads 24*a*. This will be described below in detail.

A plurality of output terminals 22*b*, a plurality of capacitor elements C20*b*, and a break inspecting wire 26*b* are located in the semiconductor chip mounting region 20*b*. The output terminals 22*b* are provided side by side in the X direction, for example, and are each connected to the source signal line 12*b* through a lead 24*b*. The output terminals 22*b* are also connected to output bumps of the semiconductor chip (source driving circuit). Thus, the semiconductor chip is electrically connected to the source signal lines 12*b* through the output terminals 22*b* and the leads 24*b*.

The output terminals 22*b* are also each connected to the common break inspecting wire 26*b* through the capacitor element C20*b*. The break inspecting wire 26*b* is connected to a break inspecting terminal 28*b* located on the array substrate 1. The capacitor elements C20*b*, the break inspecting wire 26*b*, and the break inspecting terminal 28*b* are used for inspecting a break in the source signal lines 12*b* and the leads 24*b*. This will be described below in detail.

The array substrate 1 is provided with array inspecting terminals 30*a*, 30*b*. The array inspecting terminals 30*a* are disposed in a region different from the semiconductor chip mounting region 20*a* and disposed on the side opposite to the semiconductor chip mounting region 20*a* with respect to the display region 10 in the illustration of FIG. 1. The array inspecting terminals 30*a* are connected to the two or more gate signal lines 12*a*. In the illustration of FIG. 1, the plurality of array inspecting terminals 30*a* are provided, and each of them is connected to the two gate signal lines 12*a*, for example. In the illustration of FIG. 1, the plurality of array inspecting terminals 30*a* are provided side by side in the Y direction.

The array inspecting terminals 30*b* are disposed in a region different from the semiconductor chip mounting region 20*b* and disposed on the side opposite to the semiconductor chip mounting region 20*b* with respect to the display region 10 in the illustration of FIG. 1. The array inspecting terminals 30*b* are connected to the two or more source signal lines 12*b*. In the illustration of FIG. 1, the plurality of array inspecting terminals 30*b* are provided, and each of them is connected to the two source signal lines 12*b*, for example. In the illustration of FIG. 1, the plurality of array inspecting terminals 30*b* are provided side by side in the X direction.

The array inspecting terminals 30*a*, 30*b* are terminals used in an array inspection for the single array substrate 1. In the array inspection, an inspection signal is input to the gate signal lines 12*a* through the array inspecting terminals 30*a*, 30*b*. A specific example of the array inspection will be described below.

Also in the illustration of FIG. 1, each of the array inspecting terminals 30*a* is not connected to the gate signal lines 12*a* adjacent to each other in the Y direction and is connected to the two gate signal lines 12*a* while skipping the gate signal line 12*a* therebetween. Similarly, each of the array inspecting terminals 30*b* is not connected to the source signal lines 12*b* adjacent to each other in the X direction and is connected to the two source signal lines 12*b* while skipping the source signal line 12*b* therebetween. The reason will also be described below.

Next, an array inspection method for the array substrate 1 according to the first preferred embodiment will be described.

<Array Inspection>

Here, a break inspection of the gate signal lines 12*a* and the leads 24*a* and of the source signal lines 12*b* and the leads 24*b* is described as an example of the array inspection. In addition, an inspection method disclosed in Japanese Patent Application No. JP2013-146082, for example, may be applied to this inspection, so that the specification will omit detailed descriptions and have simple descriptions.

Probes are applied to the array inspecting terminals 30*a* and the break inspecting terminal 28*a*. Then, one of the array inspecting terminals 30*a* and the break inspecting terminal 28*a* are each applied with the different potential through the probes. For example, a direct-current power supply is connected between the one array inspecting terminal 30*a* and the break inspecting terminal 28*a*.

At this time, if a path (the gate signal lines 12*a*, the leads 24*a*, the output terminals 22*a*, the capacitor elements C20*a*, and the break inspecting wire 26*a*) between the one the array inspecting terminal 30*a* and the break inspecting terminal 28*a* is not broken, the current flows through the path.

In the illustration of FIG. 1, the one array inspecting terminal 30*a* is connected to the two gate signal lines 12*a*, so that the two paths are formed between the array inspecting terminal 30*a* and the break inspecting terminal 28*a*. Each of the paths is formed of the gate signal line 12*a*, the lead 24*a*, the output terminal 22*a*, and the capacitor element C20*a*.

Meanwhile, if one of the gate signal lines 12*a* or one of the leads 24*a* connected to the one array inspecting terminal 30*a* is broken, the current flows through only one of the paths. A value of the current at this time is smaller than a value in the case where the current flows through the two paths. Therefore, when the current is detected and is smaller than the reference value, it can be determined that the gate signal line 12*a* or the lead 24*a* connected to the one array inspecting terminal 30*a* is broken. The well-known inspection device including the probes can perform the detection and the determination.

It should be noted that the inspection device hardly determines which path of the two paths connected to the array inspecting terminal 30*a* is broken. Thus, the inspection device notifies a worker of both the paths without specifying any of the paths. The worker who receives the notification checks these paths, for example, through visual inspection to specify the broken place.

The potential is successively applied to the plurality of array inspecting terminals 30*a* to repeatedly perform the above-mentioned inspection. This can inspect the break in all of the gate signal lines 12*a* and the leads 24*a*.

The inspection of the source signal lines 12*b* and the leads 24*b* is similar, thereby avoiding to repeat the description.

In the conventional array inspection, gate signal lines and source signal lines are each provided with an array inspecting terminal to inspect the gate signal lines or the source signal lines one by one. This allows to minutely specify a defective place since the defect in the signal lines can be detected by determining an electrical amount (current or voltage) in the array inspection and comparing the amount with the reference value. In other words, this allows to specify the defective place without the need for the visual inspection by the worker.

On the other hand, in the first preferred embodiment, the voltage is collectively applied to the plurality of signal lines on purpose to perform the array inspection of a unit of the plurality of signal lines. Consequently, accuracy decreases in terms of specifying the defective place, but the array inspecting terminals 30*a*, 30*b* can increase in size, allowing to contribute to the stable probing. Moreover, the probes can be easily manufactured in a sufficient size. Furthermore, life of the probes can be extended.

The array inspecting terminals 30*a*, 30*b* are provided, whereby the number of array inspecting terminals can be reduced. This can increase flexibility in placement while the common placement has hardly been adopted for a plurality of types due to the problem of spacing or the like. If the plurality of types can have the same placement, the same probe unit (inspection device) can be used. Thus, a cost of inspection can be greatly reduced.

Moreover, the two or more gate signal lines or the two or more source signal lines are connected to the one array inspecting terminal to perform the array inspection, so that the number of signal lines (namely, resolution of display image) seen from the inspection device is reduced. Thus, an inspection tact can be increased by the reduced number of signal lines. Furthermore, to make efficient use of a measurement channel (measurement terminal) of the inspection device, the greater number of array substrates 1 can be inspected simultaneously in a multi-measurement that simultaneously measures the plurality of array substrates 1.

In the first preferred embodiment, the array inspecting terminal 30*a* is connected to the two or more gate signal lines 12*a* and the array inspecting terminal 30*b* is connected to the two or more source signal lines 12*b*, but any one of the array inspecting terminals 30*a*, 30*b* may only be connected to the two or more signal lines. Here, when the array inspecting terminals 30*a* and the array inspecting terminals 30*b* do not need a distinction therebetween, they are simply referred to as array inspecting terminals, and when the gate signal lines 12*a* and the source signal lines 12*b* do not need a distinction therebetween, they are also simply referred to as signal lines.

The array inspection is not limited to the inspection described above. In other words, an inspection for a unit of two or more signal lines may be performed by inputting an inspection signal to an array inspecting terminal and detecting an electrical amount generated in the two or more signal lines connected to the array inspecting terminal. A configuration of a circuit necessary for the inspection may be modified as appropriate according to a necessary array inspection. For example, an inspection and a configuration of a circuit disclosed in Japanese Patent Application No. JP2013-146082 may be applied as appropriate.

Although the signal lines connected to the array inspecting terminal include the freely-selected number thereof, the number of signal lines is preferably ten or less, for example. Thus, accuracy of the array inspection can be ensured to some extent, and a range including a defect capable of being specified can be made narrow to some extent. It is also appropriate to connect the ten or more signal lines to the array inspecting terminal in a case where it is determined that the accuracy of the array inspection is reduced and the range including the defect capable of being specified is expanded.

<Array Substrate after Array Inspection>

In this embodiment, the two or more signal lines are connected to each other through the array inspecting terminal. Thus, in this state, different signals cannot be output to the two or more signal lines. Consequently, each pixel cannot be operated individually. Therefore, after completion of the array inspection, the connection between the two or more signal lines needs to be interrupted.

As shown in FIG. 1, for example, the array substrate 1 is cut in cutting-plane lines 90. In the illustration of FIG. 1, the cutting-plane line 90 extends between the array inspecting terminals 30*a* and the display region 10 in the Y direction. The cutting-plane line 90 crosses all of the gate signal lines 12*a*. The cutting-plane line 90 also extends between the array inspecting terminals 30*b* and the display region 10 in the X direction. The cutting-plane line 90 crosses all of the source signal lines 12*b*. Consequently, the connection between the array inspecting terminals 30*a* and the gate signal lines 12*a* (more specifically, the gate signal lines 12*a* on the display region 10 side) is interrupted, and the connection between the array inspecting terminals 30*b* and the source signal lines 12*b* (more specifically, the source signal lines 12*b* on the display region 10 side) is interrupted. Thus, the signal can be individually output to the gate signal lines 12*a* through the output terminals 22*a*, and the signal can be individually output to the source signal lines 12*b* through the output terminals 22*b*.

Alternatively, part of the gate signal lines 12*a* and part of the source signal lines 12*b* may be removed without cutting the array substrate 1. For example, part of each of the gate signal lines 12*a* between the array inspecting terminals 30*a* and the display region 10 is removed with, for example, a laser, and part of each of the source signal lines 12*b* between the array inspecting terminals 30*b* and the display region 10 is removed with, for example, a laser. Consequently, the connection between the array inspecting terminals 30*a* and the gate signal lines 12*a* (more specifically, the gate signal lines 12*a* on the display region 10 side) is interrupted, and the connection between the array inspecting terminals 30*b* and the source signal lines 12*b* (more specifically, the source signal lines 12*b* on the display region 10 side) is interrupted. Thus, the signal can be individually output to the gate signal lines 12*a* through the output terminals 22*a*, and the signal can be individually output to the source signal lines 12*b* through the output terminals 22*b*.

<Display Panel>

Figure 3:
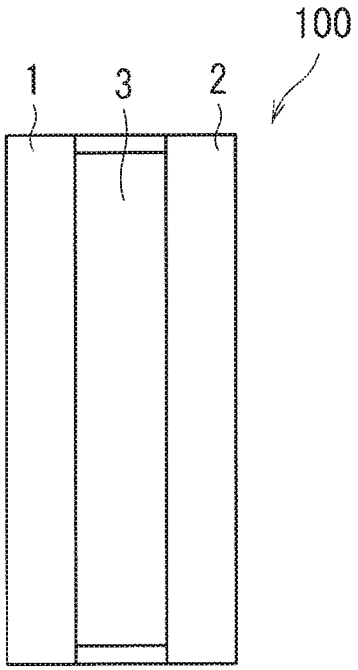
FIG. 3 is a diagram schematically showing an example of a configuration of a display panel.

The array substrate 1 with a display element can form a display panel. An example includes a liquid crystal display panel. As shown in FIG. 3, a liquid crystal display panel 100 includes a well-known counter substrate 2 including a counter electrode, the array substrate 1, and a liquid crystal 3 sealed therebetween. The array substrate 1 and the counter substrate 2 are also provided with polarizing plates, which are not shown. The counter substrate 2 includes a color filter for every pixel, for example.

The liquid crystal display panel 100 is irradiated with light such that the light passes through the array substrate 1, the counter substrate 2, and the liquid crystal 3. In the array substrate 1, voltage is applied to the gate signal lines 12*a* and the source signal lines 12*b* to apply the voltage to every pixel, to thereby control an alignment state of the liquid crystals in every pixel and thus to control a light transmittance of every pixel. Consequently, the liquid crystal display panel 100 displays a display image.

<Connection Modes Between Array Inspecting Terminals and Signal Lines>

In the illustration of FIG. 1, each of the array inspecting terminals 30*a* is not connected to the gate signal lines 12*a* adjacent to each other in the Y direction and is connected to the two gate signal lines 12*a* while skipping the gate signal line 12*a* therebetween. In other words, the two gate signal lines 12*a* adjacent to each other in X direction are connected to the different array inspecting terminals 30*a*. Similarly, each of the array inspecting terminals 30*b* is not connected to the source signal lines 12*b* adjacent to each other and is connected to the two source signal lines 12*b* while skipping the source signal line 12*b* therebetween. In other words, the two source signal lines 12*b* adjacent to each other are connected to the different array inspecting terminals 30*b*.

Thus, as one of the array inspections, the two signal lines adjacent to each other can be inspected for the presence or absence of a short circuit. It will be described below in detail.

With reference to FIG. 1, two of the array inspecting terminals 30*a* on an upper side of a page space are each referred to as array inspecting terminals 30*a*_1, 30*a*_2. The array inspecting terminal 30*a*_1 is located on the side of the page space upper than that of the array inspecting terminal 30*a*_2. Moreover, four of the gate signal lines 12*a* on the upper side of the page space are each referred to as gate signal lines 12*a*_1 to 12*a*_4. The gate signal lines 12*a*_1 to 12*a*_4 are disposed in the stated order from the upper side to a lower side of the page space.

In FIG. 1, the gate signal lines 12*a*_1, 12*a*_3 are connected to the array inspecting terminal 30*a*_1, and the gate signal lines 12*a*_2, 12*a*_4 are connected to the array inspecting terminal 30*a*_2.

The probes are applied to the array inspecting terminals 30*a*_1, 30*a*_2 to detect the presence or absence of a short circuit between two of the gate signal lines 12*a*_1 to 12*a*_4 adjacent to each other. Then, for example, the array inspecting terminals 30*a*_1, 30*a*_2 are each applied with the different potential. For example, the direct-current power supply is connected between the array inspecting terminals 30*a*_1, 30*a*_2.

If the short circuit occurs between any of the gate signal lines 12*a*_1 to 12*a*_4, the current flows between the array inspecting terminals 30*a*_1, 30*a*_2 through the short-circuit place.

Then, when the current flowing to the array inspecting terminals 30*a*_1, 30*a*_2 is detected and the current value is greater than the reference value, it is determined that the short circuit occurs between any of the gate signal lines 12*a*_1 to 12*a*_4.

The inspection device can perform the detection and the determination. It should be noted that the inspection device hardly determines where the short circuit occurs in the gate signal lines 12*a*_1 to 12*a*_4. Thus, the inspection device notifies a worker that the short circuit occurs in the gate signal lines 12*a*_1 to 12*a*_4 without specifying the short-circuit place. The worker who receives the notification specifies the short-circuit place in the gate signal lines 12*a*_1 to 12*a*_4, for example, through visual inspection.

As described above, the two adjacent signal lines are connected to the different array inspecting terminals, allowing for the short-circuit detection.

In addition, the array inspecting terminal does not necessarily need to be connected to the signal lines while skipping one of the signal lines. The array inspecting terminal may be connected to the signal lines while skipping at least one of the signal lines and the two adjacent signal lines may be connected to the different array inspecting terminals. In other words, the array substrate includes the array inspecting terminal connected to the signal lines while skipping at least one of the signal lines and the array inspecting terminal connected to two or more signal lines each adjacent to the signal lines.

Second Preferred Embodiment

Figure 4:
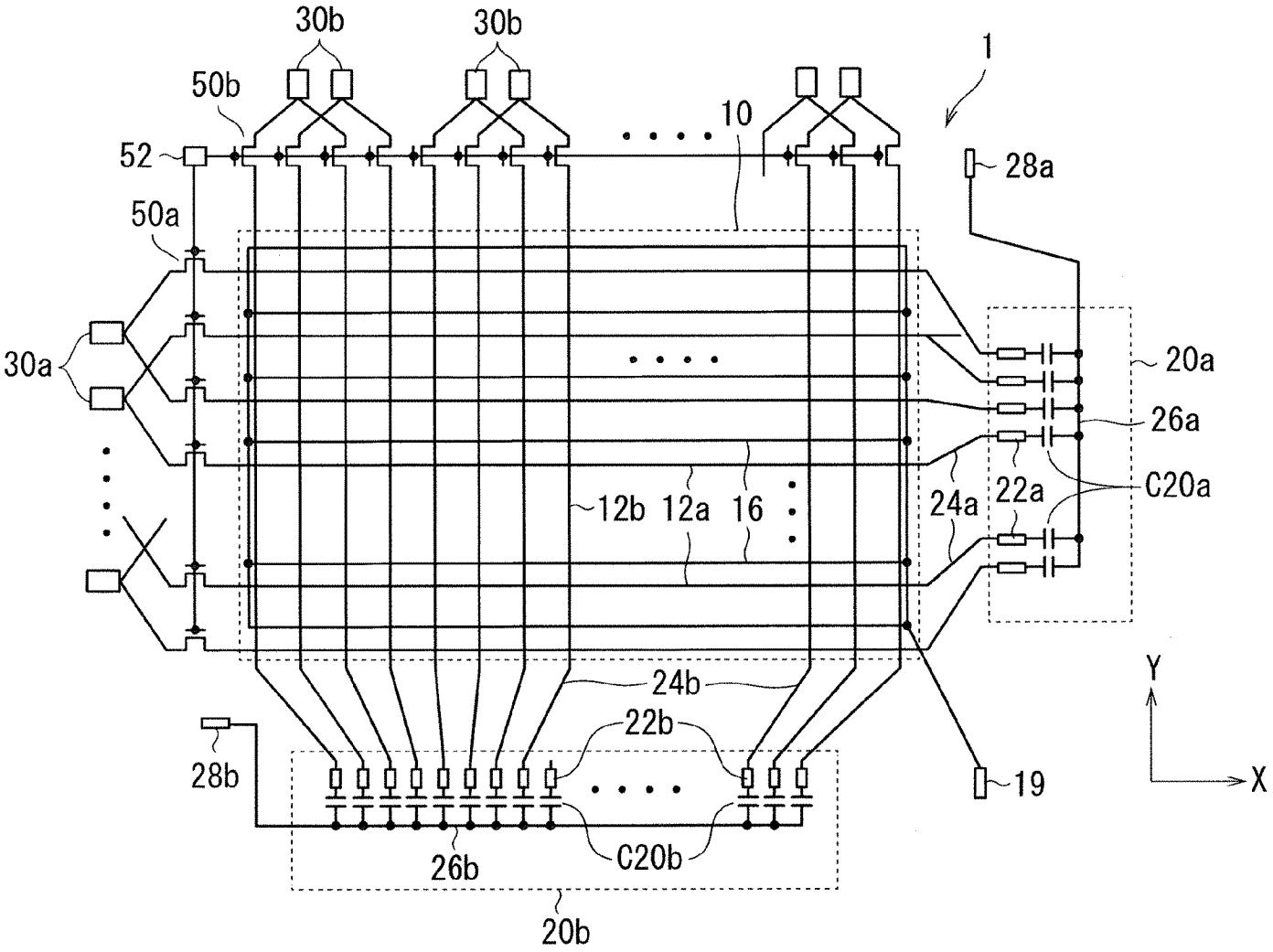
FIG. 4 is a diagram schematically showing an example of a configuration of a circuit of an array substrate according to a second preferred embodiment.

FIG. 4 is a configuration diagram schematically showing an example of a circuit formed on an array substrate 1 according to a second preferred embodiment according to the present invention. The array substrate 1 in FIG. 4 compared to the array substrate 1 in FIG. 1 includes a plurality of array inspecting switch elements 50*a*, 50*b*.

The array inspecting switch element 50*a* is located on each of the gate signal lines 12*a* between the display region 10 and the array inspecting terminals 30*a*. Thus, the array inspecting switch elements 50*a* select conduction or non-conduction between the array inspecting terminals 30*a* and the gate signal lines 12*a* (more specifically, the gate signal lines 12*a* on the display region 10 side).

The array inspecting switch element 50*b* is located on each of the source signal lines 12*b* between the display region 10 and the array inspecting terminals 30*b*. Thus, the array inspecting switch elements 50*b* select conduction or non-conduction between the array inspecting terminals 30*b* and the source signal lines 12*b* (more specifically, the source signal lines 12*b* on the display region 10 side).

An array inspecting switch terminal 52 is located on the array substrate 1. The array inspecting switch terminal 52 is connected to all control electrodes of the array inspecting switch elements 50*a*, 50*b*. A signal is input to the array inspecting switch terminal 52, whereby the array inspecting switch elements 50*a*, 50*b* can be controlled.

When the array inspection is performed, a signal for turning the array inspecting switch elements 50*a*, 50*b* on is input to the array inspecting switch terminal 52, to thereby electrically connect the array inspecting terminals 30*a* and the gate signal lines 12*a* and electrically connect the array inspecting terminals 30*b* and the source signal lines 12*b*.

Thus, the array inspection using the array inspecting terminals 30*a*, 30*b* can be performed. The example of the array inspection is as described in the first preferred embodiment.

On the other hand, when the array inspection is not performed, a signal for turning the array inspecting switch elements 50*a*, 50*b* off is input to the array inspecting switch terminal 52. Thus, a signal can be individually output to each of the gate signal lines 12*a* through the output terminals 22*a*, and a signal can be individually output to each of the source signal lines 12*b* through the output terminals 22*b*.

The first preferred embodiment has a concern that cutting of the array substrate 1 or removal of the signal lines causes scattered matter. In this case, a step of removing the scattered matter attached on the array substrate 1 may be needed. However, as in the second preferred embodiment, using the array inspecting switch elements 50*a*, 50*b* can eliminate the step.

Third Preferred Embodiment

Figure 5:
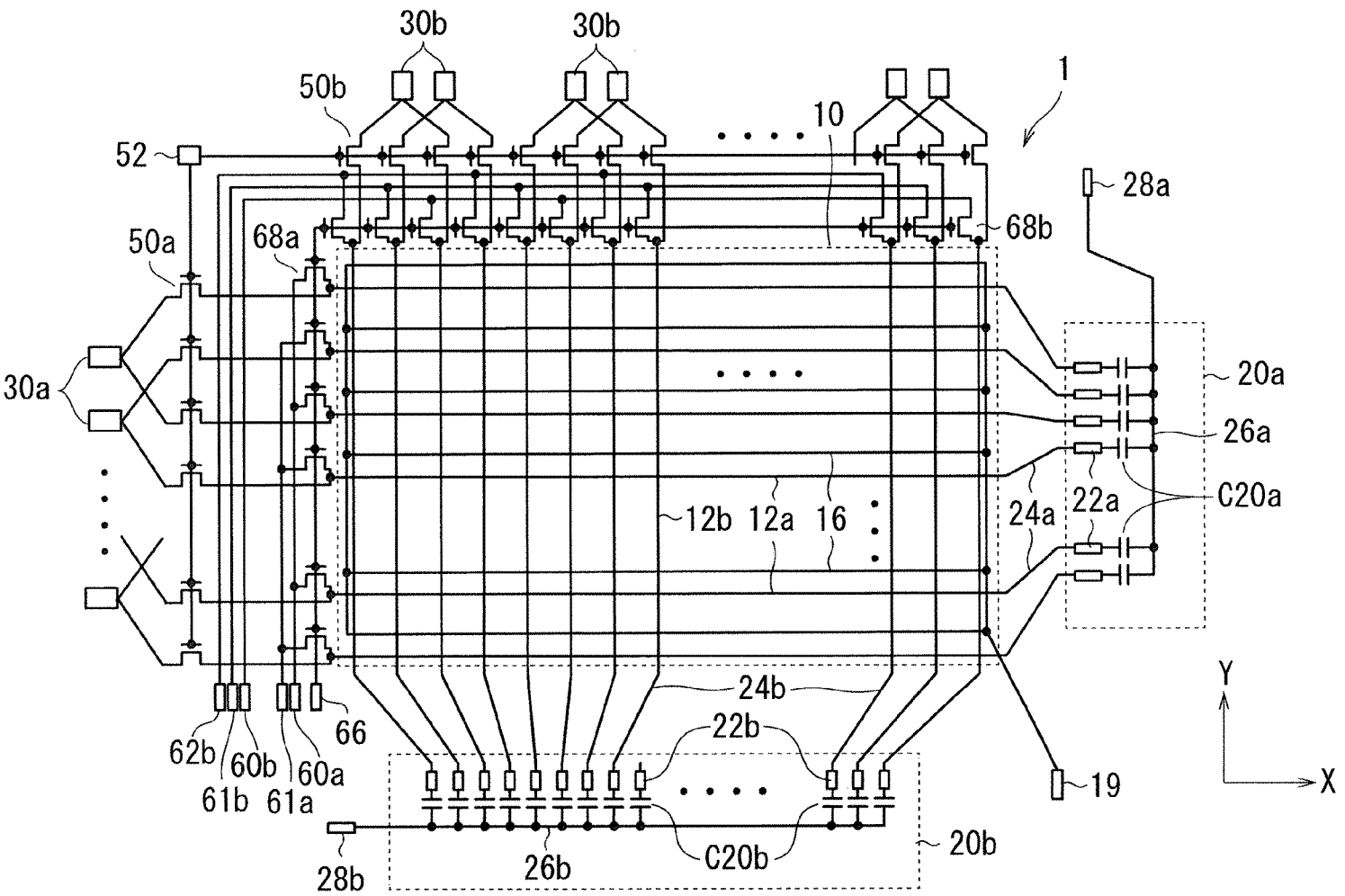
FIGS. 5 and 6 are diagrams schematically showing an example of a configuration of a circuit of an array substrate according to a third preferred embodiment.

FIG. 5 is a configuration diagram schematically showing an example of a circuit formed on an array substrate 1 according to a third preferred embodiment according to the present invention. The first preferred embodiment and the second preferred embodiment show the case where only the array inspecting terminals 30*a*, 30*b* are disposed, but a collective lighting inspecting circuit is also provided herein.

The array substrate 1 in FIG. 5 compared to the array substrate 1 in FIG. 4 includes collective lighting inspecting terminals 60*a*, 61*a*, 60*b* to 62*b* and collective lighting inspecting switch elements 68*a*, 68*b* that serve as the collective lighting inspecting circuit.

The collective lighting inspecting terminals 60*a*, 61*a* are each connected to the gate signal lines 12*a* through the collective lighting inspecting switch elements 68*a*. The collective lighting inspecting switch element 68*a* is provided with respect to each of the gate signal lines 12*a*. In the illustration of FIG. 5, the collective lighting inspecting terminal 60*a* is connected to the every other gate signal lines 12*a* and connected to, for example, odd-numbered (odd-addressed) gate signal lines 12*a*. The collective lighting inspecting terminal 61*a* is connected to the gate signal lines 12*a* that are not connected to the collective lighting inspecting terminal 60*a* and connected to, for example, even-numbered (even-addressed) gate signal lines 12*a*.

The number of (two herein) collective lighting inspecting terminals 60*a*, 61*a* connected to the gate signal lines 12*a* is lower than that of array inspecting terminals 30*a* connected to the gate signal lines 12*a*.

The collective lighting inspecting terminals 60*b* to 62*b* are each connected to the source signal lines 12*b* through the collective lighting inspecting switch elements 68*b*. The collective lighting inspecting switch element 68*b* is provided with respect to each of the source signal lines 12*b*. In the illustration of FIG. 5, the collective lighting inspecting terminals 60*b* to 62*b* are each connected to the source signal lines 12*b* while skipping two of the source signal lines 12*b* therebetween. More specifically, the collective lighting inspecting terminal 60*b* is connected to the (3N−2)th (N is a natural number) source signal lines 12*b*, the collective lighting inspecting terminal 61*b* is connected to the (3N−1) th source signal lines 12*b*, and the collective lighting inspecting terminal 62*b* is connected to the 3Nth source signal lines 12*b*.

Here, red pixels, blue pixels, and green pixels are assumed to be disposed side by side in the stated order in the X direction, and the collective lighting inspecting terminals 60*b* to 62*b* are connected to the source signal lines 12*b* of the pixels corresponding to each color. For example, the collective lighting inspecting terminal 60*b* is connected to the source signal lines 12*b* corresponding to the red pixels, the collective lighting inspecting terminal 61*b* is connected to the source signal lines 12*b* corresponding to the blue pixels, and the collective lighting inspecting terminal 62*b* is connected to the source signal lines 12*b* corresponding to the green pixels.

The number of (three herein) collective lighting inspecting terminals 60*b* to 62*b* connected to the source signal lines 12*b* is lower than that of array inspecting terminals 30*b* connected to the source signal lines 12*b*.

An collective lighting inspecting switch terminal 66 is located on the array substrate 1. The collective lighting inspecting switch terminal 66 is connected to all control electrodes of the collective lighting inspecting switch elements 68*a*, 68*b*.

The array substrate 1 can perform the collective lighting inspection as described below.

<Collective Lighting Inspection>

The collective lighting inspection is performed in a display panel state. In other words, the collective lighting inspection is performed after the display panel formed of the array substrate 1 and the display element is manufactured (for example, see the liquid crystal display panel 100 in FIG. 3). The collective lighting inspection checks an inspection display image displayed on the display panel. Thus, in a case where the display panel is the liquid crystal display panel 100, an irradiation device that irradiates the liquid crystal display panel 100 with light is provided.

In the collective lighting inspection, the probe is applied to each of the terminals 19, 60*a*, 61 *a*, 60*b* to 62*b*, 66. Then, a predetermined potential is applied to the common wire terminal 19, and a signal for turning the collective lighting inspecting switch elements 68*a*, 68*b* on is output to the collective lighting inspecting switch terminal 66. Consequently, an inspection signal can be applied to the gate signal lines 12*a* and the source signal lines 12*b* through the collective lighting inspecting terminals 60*a*, 61*a*, 60*b* to 62*b*.

Then, for example, the inspection signal is input to the collective lighting inspecting terminals 60*a*, 60*b*. Consequently, only the pixels of a predetermined color (for example, red) among the even-numbered pixels in the Y direction are operated. At this time, the inspection display image displayed on the display panel is inspected whether it is correctly displayed.

Then, the inspection signal is input to the collective lighting inspecting terminals 60*a*, 61 *a*, 60*b* to 62*b* as appropriate, and the similar inspection method checks the operations of all the pixels. Thus, the collective lighting inspection is performed.

After completion of the collective lighting inspection, the collective lighting inspecting switch elements 68*a*, 68*b* are turned off.

In the third preferred embodiment, the two collective lighting inspecting terminals 60*a*, 61*a* are provided as the collective lighting inspecting terminals connected to the gate signal lines 12*a*, but the number of collective lighting inspecting terminals connected to the gate signal lines 12*a* may be set freely. Similarly, the number of collective lighting inspecting terminals connected to the source signal lines 12*b* may also be set freely.

<Differences Between Array Inspecting Terminals and Collective Lighting Inspecting Terminals>

In the collective lighting inspection as described above, the inspection display image (display pattern) is displayed on the display panel and the inspection display image is checked to see that each of the pixels operates properly. In other words, in the collective lighting inspection different from the array inspection, the electrical amount is not detected, and the image is optically identified (for example, visual inspection) to determine whether each of the pixels emits proper light. Therefore, to improve inspection efficiency, the collective lighting inspection operates the plurality of pixels at the same time for checking the inspection display image displayed by the plurality of pixels at once, instead of successively operating the pixels one by one for checking the pixels one by one.

Hence, as shown in FIG. 5, each of the collective lighting inspecting terminals 60*a*, 61*a* is connected to the plurality of gate signal lines 12*a*, and each of the collective lighting inspecting terminals 60*b* to 62*b* is connected to the plurality of source signal lines 12*b*. This can cause to simultaneously operate the plurality of pixels.

However, the collective lighting inspecting terminals 60*a*, 61*a*, 60*b* to 62*b* are terminals for displaying the inspection display image in the collective lighting inspection and are unlike, in terms of technical ideas, the array inspecting terminals 30*a*, 30*b* that used for performing the inspection by detecting the electrical amount without displaying the inspection display image. In other words, even if each of the collective lighting inspecting terminals 60*a*, 61*a*, 60*b* to 62*b* is connected to the plurality of signal lines, applying the collective lighting inspecting terminals 60*a*, 61*a*, 60*b* to 62*b* to the array inspecting terminals 30*a*, 30*b* cannot be derived from the technical ideas (ideas of checking the inspection display image) in the collective lighting inspection.

<Switch Elements>

In the illustration of FIG. 5, the array inspecting switch elements 50*a*, 50*b* and the collective lighting inspecting switch elements 68*a*, 68*b* are provided. Thus, when the array inspection is performed, the collective lighting inspecting switch elements 68*a*, 68*b* can be turned off. This can avoid an influence of the collective lighting inspecting terminals 60*a*, 61 *a*, 60*b* to 62*b* and perform the array inspection. Similarly, when the collective lighting inspection is performed, the array inspecting switch elements 50*a*, 50*b* can be turned off. This can avoid an influence of the array inspecting terminals 30*a*, 30*b* and perform the collective lighting inspection.

Figure 6:
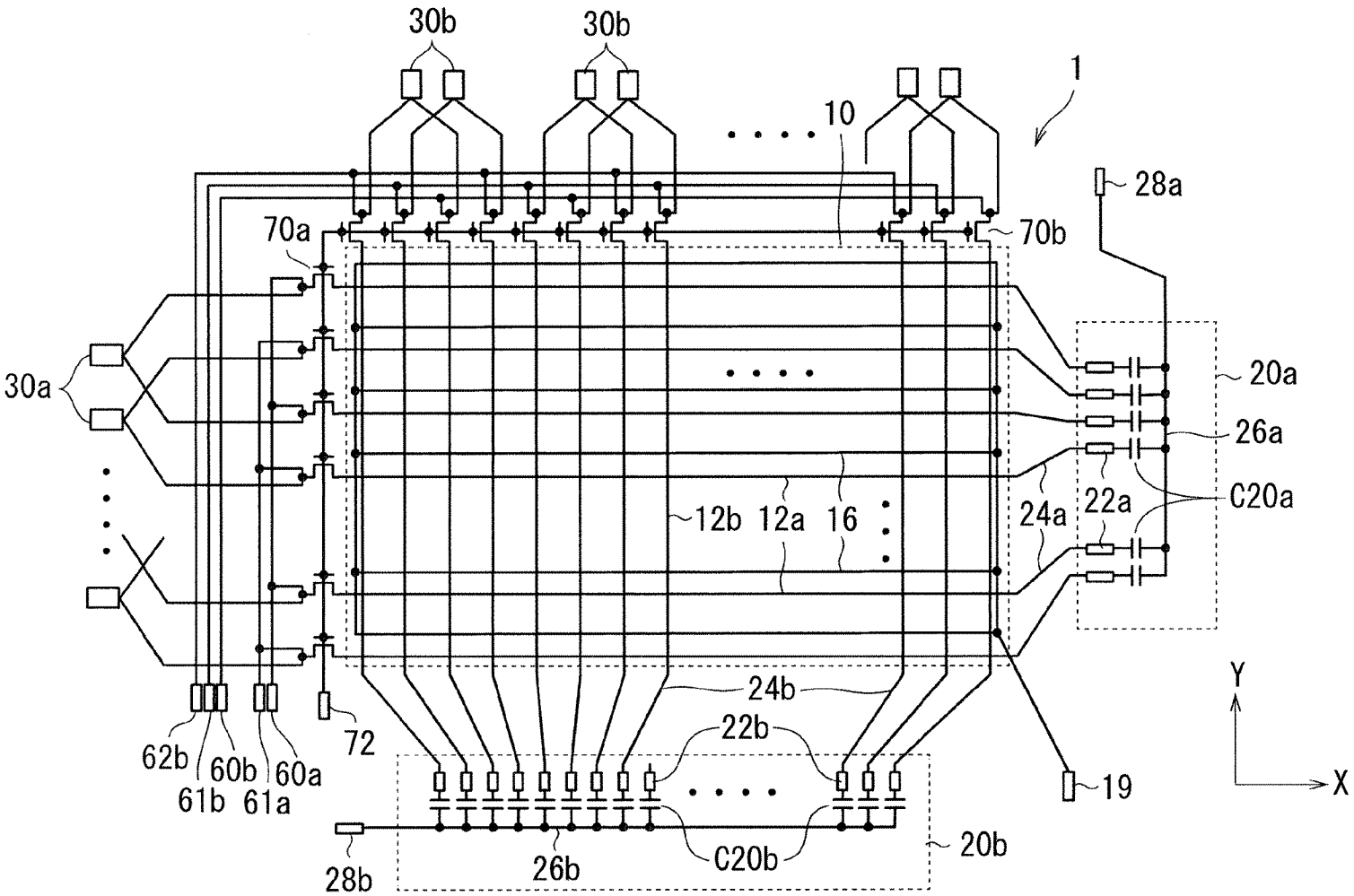

On the other hand, when the influences are negligible, switch elements having both the functions of the array inspecting switch elements 50*a*, 50*b* and the collective lighting inspecting switch elements 68*a*, 68*b* may be provided. For example, in FIG. 6, inspection switch elements 70*a*, 70*b*, and an inspection switch terminal 72 are provided. One ends of the inspection switch elements 70*a* are connected in common to the array inspecting terminals 30*a* and the collective lighting inspecting terminal 60*a* (or 61*a*). The other ends of the inspection switch elements 70*a* are connected to the gate signal lines 12*a* (more specifically, the gate signal lines 12*a* on the display region 10 side). Similarly, one ends of the inspection switch elements 70*b* are connected to the array inspecting terminals 30*b* and the collective lighting inspecting terminal 60*b* (or 61*b* or 62*b*). The other ends of the inspection switch elements 70*b* are connected to the source signal lines 12*b* (more specifically, the source signal lines 12*b* on the display region 10 side). The inspection switch terminal 72 is connected to all control electrodes of the inspection switch elements 70*a*, 70*b*.

Upon the array inspection or the collective lighting inspection, the inspection switch elements 70*a*, 70*b* are turned on. When these inspections are not performed, the inspection switch elements 70*a*, 70*b* are turned off.

The array substrate 1 can reduce the size of the circuit as compared to that in FIG. 5. Furthermore, the manufacturing cost can be reduced.

In terms of sharing the circuit, part of wiring pattern disposed for the collective lighting inspecting circuit may be used as the array inspecting terminals. This can reduce the manufacturing cost.

In addition, according to the present invention, the above preferred embodiments can be arbitrarily combined, or each preferred embodiment can be appropriately varied or omitted within the scope of the invention.

While the invention has been shown and described in detail, the foregoing description is in all aspects illustrative and not restrictive. It is therefore understood that numerous modifications and variations can be devised without departing from the scope of the invention.

What is claimed is:

1. An array substrate, comprising:

a plurality of first signal lines extending parallel to each other;

a plurality of second signal lines extending parallel to each other and intersecting said plurality of first signal lines;

a pixel switch element located at an intersection of each of said plurality of first signal lines and each of said plurality of second signal lines;

a first array inspecting terminal connected to two or more third signal lines of said plurality of first signal lines, said first array inspecting terminal receiving an inspection signal for generating a voltage or a current in said two or more third signal lines to perform an inspection for a unit of said two or more third signal lines by detecting a value of said voltage or said current;

a second array inspecting terminal connected to two or more fourth signal lines of said plurality of first signal lines, the fourth signal lines being each adjacent to said two or more third signal lines;

a third array inspecting terminal connected to two or more fifth signal lines of said plurality of second signal lines; and a fourth array inspecting terminal connected to two or more sixth signal lines of said plurality of second signal lines, the sixth signal lines being each adjacent to said two or more fifth signal lines, wherein at least one of said fourth signal lines is located between said two or more third signal lines and at least one of said sixth signal lines is located between said two or more fifth signal lines, and wherein said at least one of said fourth signal lines is separated from said first array inspecting terminal and said at least one of said sixth signal lines is separated from said third array inspecting terminal.

2. The array substrate according to claim 1, further comprising an array inspecting switch element that selects conduction or non-conduction between each of said two or more third signal lines and said first array inspecting terminal.

3. An array substrate comprising:

a plurality of first signal lines extending parallel to each other;

a plurality of second signal lines extending parallel to each other and intersecting said plurality of first signal lines;

a pixel switch element located at an intersection of each of said plurality of first signal lines and each of said plurality of second signal lines;

a first array inspecting terminal connected to two or more third signal lines of said plurality of first signal lines, said first array inspecting terminal receiving an inspection signal for generating a voltage or a current in said two or more third signal lines to perform an inspection for a unit of said two or more third signal lines by detecting a value of said voltage or said current;

pixel electrodes that are located in a plurality of pixel regions and are applied with voltage through said pixel switch element, each of the pixel regions being surrounded by each of said plurality of first signal lines and each of said plurality of second signal lines;

a first lighting inspecting terminal connected to two or more signal lines of said plurality of first signal lines; and a second lighting inspecting terminal connected to two or more signal lines of said plurality of second signal lines, wherein in a state where a display panel is formed of said array substrate and a display element that changes display in response to the voltage of said pixel electrodes, said first lighting inspection terminal and said second lighting inspecting terminal are configured to receive a second inspection signal for displaying an inspection display image.

4. The array substrate according to claim 3, further comprising inspection switch elements, wherein one end of each of said inspection switch elements is connected to said first lighting inspecting terminal and said first array inspecting terminal, and the other end of each of said inspection switch elements is connected to each of said two or more third signal lines.

5. The array substrate according to claim 1, wherein the number of said two or more third signal lines is ten or less.

6. A method for inspecting an array substrate that comprises a plurality of first signal lines extending parallel to each other, a plurality of second signal lines extending to parallel to each other and intersecting said plurality of first signal lines, a pixel switch element located at an intersection of each of said plurality of first signal lines and each of said plurality of second signal lines, a first array inspecting terminal connected to two or more third signal lines of said plurality of first signal lines, a second array inspecting terminal connected to two or more fourth signal lines of said plurality of first signal lines, the fourth signal lines being each adjacent to said two or more third signal lines, a third array inspecting terminal connected to two or more fifth signal lines of said plurality of second signal lines, and a fourth array inspecting terminal connected to two or more sixth signal lines of said plurality of second signal lines, the sixth signal lines being each adjacent to said two or more fifth signal lines, wherein at least one of said fourth signal lines is located between said two or more third signal lines and at least one of said sixth signal lines is located between said two or more fifth signal lines, and wherein said at least one of said fourth signal lines is separated from said first array inspecting terminal and said at least one of said sixth signal lines is separated from said third array inspecting terminal, the method comprising:

inputting an inspection signal for generating a voltage or a current in said two or more third signal lines to said first array inspecting terminal;

detecting said voltage or said current to perform an inspection for a unit of said two or more third signal lines; and performing an inspection for a short circuit between said two or more third signal lines and said two or more fourth signal lines.

7. The method for inspecting an array substrate according to claim 6, wherein said plurality of first signal lines, said plurality of second signal lines, and said first array inspecting terminal are located on a substrate, and said method further comprises:

cutting said substrate, after completion of said inspection, to interrupt the connection between said first array inspecting terminal and said two or more third signal lines.

8. The method for inspecting an array substrate according to claim 6, further comprising:

removing part of each of said two or more third signal lines with a laser, after completion of said inspection, to interrupt the connection between said two or more third signal lines and said first array inspecting terminal.

9. The method for inspecting an array substrate according to claim 6, wherein said array substrate further comprises array inspecting switch elements each having one end connected to said first array inspecting terminal and the other end connected to each of said two or more third signal lines, and said method further comprises:

turning said array inspecting switch elements on when said inspection is performed; and turning said array inspecting switch elements off after completion of said inspection.

10. A method for inspecting a display panel, comprising:

performing a method for inspecting an array substrate that comprises a plurality of first signal lines extending parallel to each other, a plurality of second signal lines extending to parallel to each other and intersecting said plurality of first signal lines, a pixel switch element located at an intersection of each of said plurality of first signal lines and each of said plurality of second signal lines, and a first array inspecting terminal connected to two or more third signal lines of said plurality of first signal lines, including:

inputting an inspection signal for generating a voltage or a current in said two or more third signal lines to said first array inspecting terminal; and detecting said voltage or said current to perform an inspection for a unit of said two or more third signal lines;

inputting a second inspection signal to each of a first lighting inspecting terminal and a second lighting inspecting terminal to drive display elements to display an inspection display image on a display panel, said first lighting inspecting terminal being connected to two or more ones of said plurality of first signal lines, said second lighting inspecting terminal being connected to two or more ones of said plurality of second signal lines, said display panel including said array substrate and said display elements that change display in response to a voltage of pixel electrodes, said pixel electrodes being located in a plurality of pixel regions and applied with said voltage through said pixel switch element, each of the pixel regions being surrounded by each of said plurality of first signal lines and each of said plurality of second signal lines, said pixel electrodes as well as said first lighting inspecting terminal and said second lighting inspecting terminal being included in said array substrate; and performing a lighting inspection to determine whether said inspection display image is correctly displayed.

* * * * *